US007934553B2

(12) United States Patent
Malone

(10) Patent No.: US 7,934,553 B2
(45) Date of Patent: May 3, 2011

(54) METHOD FOR CONTROLLING PLACEMENT AND FLOW AT MULTIPLE GRAVEL PACK ZONES IN A WELLBORE

(75) Inventor: Bradley P. Malone, Manhattan, KS (US)

(73) Assignee: Schlumberger Technology Corporation, Sugar Land, TX (US)

( * ) Notice: Subject to any disclaimer, the term of this patent is extended or adjusted under 35 U.S.C. 154(b) by 101 days.

(21) Appl. No.: 12/106,745

(22) Filed: Apr. 21, 2008

(65) Prior Publication Data

US 2009/0260835 A1 Oct. 22, 2009

(51) Int. Cl.

| | |
|---|---|
| ***E21B 43/04*** | (2006.01) |
| ***E21B 37/00*** | (2006.01) |
| ***E21B 34/00*** | (2006.01) |
| ***E03B 3/18*** | (2006.01) |
| ***E03B 3/26*** | (2006.01) |

(52) U.S. Cl. ..... 166/278; 166/205; 166/311; 166/332.4

(58) Field of Classification Search ..... 166/278, 166/332.4

See application file for complete search history.

(56) References Cited

U.S. PATENT DOCUMENTS

| | | | | |
|---|---|---|---|---|
| 4,917,191 | A | 4/1990 | Hopmann et al. | |
| 5,090,481 | A * | 2/1992 | Pleasants et al. | 166/373 |
| 5,156,210 | A * | 10/1992 | Roth | 166/319 |
| 5,305,833 | A | 4/1994 | Collins | |
| 5,551,514 | A | 9/1996 | Nelson et al. | |
| RE36,466 | E | 12/1999 | Nelson et al. | |
| 6,172,011 | B1 | 1/2001 | Card et al. | |
| 6,394,184 | B2 | 5/2002 | Tolman et al. | |
| 6,450,260 | B1 | 9/2002 | James et al. | |
| 6,464,006 | B2 * | 10/2002 | Womble | 166/276 |
| 6,534,449 | B1 | 3/2003 | Gilmour et al. | |
| 6,543,538 | B2 | 4/2003 | Tolman et al. | |
| 6,631,768 | B2 * | 10/2003 | Patel et al. | 166/373 |
| 6,722,439 | B2 | 4/2004 | Garay et al. | |
| 6,732,800 | B2 | 5/2004 | Acock et al. | |
| 6,755,257 | B2 | 6/2004 | Spencer et al. | |
| 6,758,272 | B2 | 7/2004 | Bixenman et al. | |
| 6,776,239 | B2 | 8/2004 | Eslinger et al. | |
| 6,789,624 | B2 | 9/2004 | McGregor et al. | |
| 6,828,280 | B2 | 12/2004 | England et al. | |
| 6,837,309 | B2 | 1/2005 | Boney et al. | |
| 6,883,608 | B2 | 4/2005 | Parlar et al. | |
| 6,907,936 | B2 | 6/2005 | Fehr et al. | |
| 6,932,157 | B2 | 8/2005 | McGregor et al. | |
| 6,938,693 | B2 | 9/2005 | Boney et al. | |
| 6,957,701 | B2 | 10/2005 | Tolman et al. | |
| 6,961,663 | B2 | 11/2005 | Sinclair et al. | |
| 6,983,795 | B2 | 1/2006 | Zuklic et al. | |
| 7,021,384 | B2 | 4/2006 | Themig | |
| 7,059,407 | B2 | 6/2006 | Tolman et al. | |
| 7,066,260 | B2 | 6/2006 | Sullivan et al. | |
| 7,100,691 | B2 | 9/2006 | Nguyen et al. | |
| 7,108,067 | B2 | 9/2006 | Themig et al. | |

(Continued)

*Primary Examiner* — Jennifer H Gay

(74) *Attorney, Agent, or Firm* — David G. Matthews; Rodney Warfford

(57) ABSTRACT

A technique utilizes a tool to selectively shift flow control devices in a variety of well applications. In one application, the tool is delivered downhole via coiled tubing to selectively deliver treatment fluid and shift valves in a combined well treatment and sand control well system. The tool also can be used to carry a jetting device that can be employed to deliver a non-solids fluid to a desired region of a wellbore.

6 Claims, 4 Drawing Sheets

U.S. PATENT DOCUMENTS

| | | | | |
|---|---|---|---|---|
| 7,108,073 | B2 * | 9/2006 | Patel | 166/386 |
| 7,128,152 | B2 | 10/2006 | Anyan et al. | |
| 7,128,160 | B2 | 10/2006 | Anyan et al. | |
| 7,134,493 | B2 | 11/2006 | Runia | |
| 7,134,505 | B2 | 11/2006 | Fehr et al. | |
| 7,185,703 | B2 | 3/2007 | Jannise et al. | |
| 7,207,388 | B2 | 4/2007 | Samuel et al. | |
| 7,243,723 | B2 | 7/2007 | Surjaatmadja et al. | |
| 7,243,724 | B2 | 7/2007 | McGregor et al. | |
| 7,296,624 | B2 | 11/2007 | Rodet et al. | |
| 2002/0148610 | A1 * | 10/2002 | Bussear et al. | 166/278 |
| 2002/0166667 | A1 * | 11/2002 | Patel et al. | 166/373 |
| 2003/0127227 | A1 | 7/2003 | Fehr et al. | |
| 2004/0118564 | A1 | 6/2004 | Themig et al. | |
| 2004/0129422 | A1 | 7/2004 | Themig | |
| 2005/0126787 | A1 | 6/2005 | Gomez | |
| 2005/0178552 | A1 | 8/2005 | Fehr et al. | |
| 2006/0090906 | A1 | 5/2006 | Themig | |
| 2007/0007007 | A1 | 1/2007 | Themig et al. | |
| 2007/0039741 | A1 * | 2/2007 | Hailey, Jr. | 166/376 |
| 2007/0144746 | A1 | 6/2007 | Jonas | |
| 2007/0151734 | A1 | 7/2007 | Fehr et al. | |
| 2007/0163781 | A1 * | 7/2007 | Walker | 166/313 |
| 2007/0256826 | A1 | 11/2007 | Ceccarelli et al. | |
| 2008/0164027 | A1 * | 7/2008 | Sanchez | 166/278 |
| 2009/0139717 | A1 * | 6/2009 | Richard et al. | 166/278 |

* cited by examiner

METHOD FOR CONTROLLING PLACEMENT AND FLOW AT MULTIPLE GRAVEL PACK ZONES IN A WELLBORE

BACKGROUND

The statements in this section merely provide background information related to the present disclosure and may not constitute prior art. In a variety of well related applications, downhole completions are provided with flow control devices. The flow control devices have a plurality of operational positions and can be shifted between those operational positions at specific times during a downhole procedure. For example, the flow control devices may be shifted between a full flow position and a no flow position.

The flow control devices may comprise valves that are shifted by balls or darts dropped through the wellbore. In certain multi-stage fracturing system applications, for example, valves are placed in a plurality of well intervals and the flow of fracturing fluid to select intervals is controlled by the valves. The valves can be shifted from closed to open positions by balls or darts as the fracturing process is moved to sequential well intervals. At times, however, the use of balls or darts can be limiting with respect to efficiency and functionality. Additionally, there is no method of reversing the position of the valve with a dart or ball mechanism.

SUMMARY

In general, the present invention provides a system and method in which a tool is used to selectively shift flow control devices or other well components in, for example, gravel packing applications. In one application, the tool further comprises a jetting device that can be used to deliver fluid downhole for well treatments or other applications. The tool may be deployed downhole via coiled tubing to selectively shift valves in a combined well treatment and sand control well system.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
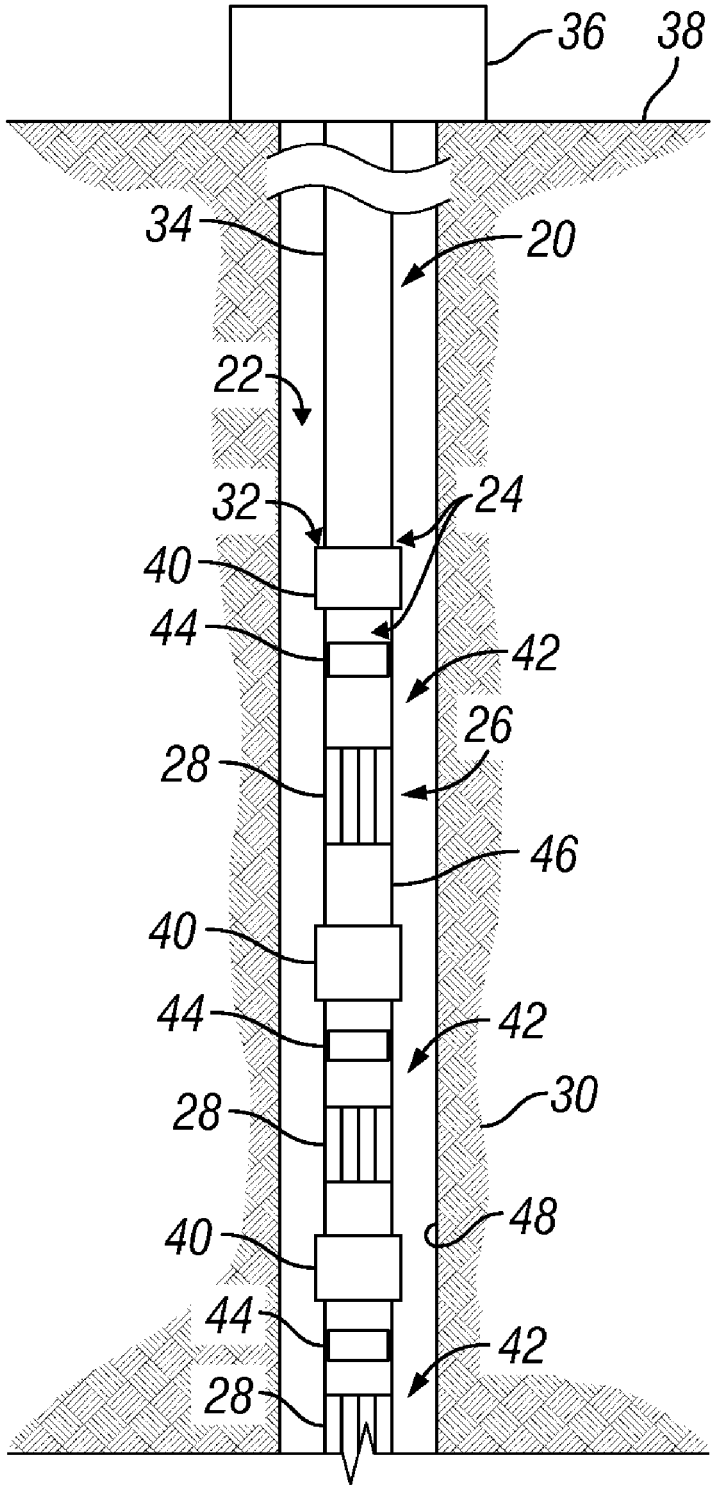
FIG. 1 is a schematic front elevation view of a well system deployed in a wellbore and comprising a tool, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method that utilize a tool for facilitating various downhole procedures. The tool may be deployed on coiled tubing to shift various downhole components. For example, the tool may comprise an actuation mechanism that is selectively actuated to shift valves, or other downhole components, between operational configurations. In certain applications, the tool also may comprise a jetting device to deliver various treatment fluids.

In one application, a well system is run into a wellbore and actuated to isolate a plurality of sections along the wellbore. The well system comprises a completion having flow valves that can be used to inject treatment fluid, e.g. solids laden fracturing fluid, into each of the sections. After the fluids have been placed into the screen annulus, the flow valves can be closed with the shifting tool. The completion also comprises a plurality of screen assemblies through which production fluid can flow into the well system following the treatment procedure. Each screen assembly also may comprise an isolation valve that can be used to selectively reduce or block flow through individual screen assemblies at specific isolated sections along the wellbore. In this embodiment, the well system also comprises the tool which is moved downhole into the completion via coiled tubing to interact with the flow valves and/or the isolation valves.

In some embodiments, the tool is utilized to deliver treatment fluid to select flow valves via the jetting device. In other embodiments, the treatment fluid may be delivered via: coiled tubing; coiled tubing in conjunction with the jetting device; production tubing annulus; annulus surround the coiled tubing; and other flow paths. These approaches may be used for many types of treatment fluids, including solids laden fluids, viscosified solids free fluids, slickwater fluids, and the like, and may be used to deliver fluids at any practical injection rate, including high injection rates. When delivery of the treatment fluid in a given well section is completed, the actuation mechanism of the tool can be actuated to engage and close the flow valve for that particular section. The treatment process can then be conducted at sequential well sections until treatment of the multi-stage well is completed. Upon completion of the well treatment, the tool can be used for cleanup procedures and other application related procedures. For example, the tool can fluidize and jet solids from the internal area of the well tubular by mobilizing the solids through an annulus formed between coiled tubing and production tubing, thereby enabling relocation and substantial removal of the solids. Further, the tool can be used to shift isolation valves to control the flow of production fluid into the completion through the screen assemblies at select sections of the wellbore.

The jetting device is designed to fluidize settled sand, proppant or gravel. Fluidizing creates a slurry and enables cleaning of the well down to the region of a flow valve within a specific well zone. Once the well zone is cleaned to expose the flow valve, the tool can be activated to, for example, enable closure of a flow valve that had been opened to allow access for placing the sand/proppant/gravel into an annulus area.

Generally, the jetting device comprises relatively small diameter orifices through which fluid is flowed under pressure to create jets with substantial energy. The jetting device can be used to deliver treatment fluids, e.g. stimulation fluids, but the orifices typically are not large enough to allow the flow of solids laden fluid (slurry) down through tubing and out through the jetting device. The gravel pack, fracpack, or other solids laden slurry can be delivered downhole along an annulus surrounding the tubing, e.g. coiled tubing, used to convey the tool downhole. For example, the slurry can be flowed down through the annulus and out through a flow valve in a specific well zone after opening the flow valve with the shifting tool. Once the sand/proppant/gravel has been placed, the jetting tool can be used to clean the well zone so as to allow the flow valve to be shifted to a closed position via the tool. Accordingly, many treatment procedures may utilize a gravel packing procedure in which slurry is flowed to a well zone through the annulus, and the tool can be used to shift appropriate flow valves. If the tool is equipped with a jetting device, the device can be used to fluidized excess sediment which is circulated from the well to enable access to the flow valve.

Referring generally to FIG. 1, one embodiment of a well system 20 that utilizes a tool to selectively shift well components, e.g. valves, is illustrated. The well system 20 is illustrated as deployed in a wellbore 22. In this example, well system 20 is designed to carry out well treatment procedures and sand control to facilitate production. However, the tool described below can be used in a variety of other procedures and applications for delivering a variety of fluids downhole and for shifting a variety of well components. As illustrated, well system 20 comprises a multi-stage treatment system 24 combined with a sand control system 26 having screen assemblies 28 that serve as the primary flow path into wellbore 22 and well system 20 from a surrounding formation 30.

The multi-stage treatment system 24 and the sand control system 26 are combined in a single tubing string/completion 32 deployed in wellbore 22 via a conveyance 34, such as coiled tubing, jointed tubing, or any other suitable conveyance. In the example illustrated, well system 20 is deployed into a generally vertical well extending down from a surface rig 36 or other deployment equipment positioned at a surface location 38. However, well system 20 also can be deployed into deviated wellbores, such as horizontal wellbores.

Multi-stage treatment system 24 comprises a plurality of isolation devices 40, e.g. packers, that can be actuated to isolate sections 42 along wellbore 24. The multi-stage treatment system 24 further comprises a plurality of flow valves 44 with a flow valve(s) 44 disposed in each section 42 between adjacent packers 40. The flow valve(s) 44 can be used to direct/inject treatment fluid into each isolated well section 42 during a treatment procedure. For example, flow valve(s) 44 can be used to direct a fracturing fluid into the surrounding formation 30 at each well section 42 to fracture the desired formation zones, thereby promoting the flow of production fluids to wellbore 22. In many applications, the treatment procedure is conducted at individual well sections 42 and progresses from one well section 42 to the next. In a specific application, the multi-stage treatment system 24 is used to conduct a well stimulation procedure by placing the flow valve(s) 44 between external packers 40 at multiple well sections 42. The packers 40 function to divide the well into manageable sections that enable stimulation and production specific to the interval bounded by packers at each end of that interval/well section. Examples of stimulation procedures include matrix stimulation, acid fracturing stimulation, gravel packing, frac packing and propped fracturing stimulation.

Upon completion of the treatment procedure, production fluid can be flowed from the various regions of formation 30 into screen assemblies 28 at each isolated well section 42. In the embodiment illustrated, packers 40, flow valves 44, and screen assemblies 28 are mounted on a tubular structure 46. The tubular structure 46 can be used to receive production fluids, e.g. oil, through screen assemblies 28 and also to receive a shifting tool/fluid delivery tool as discussed below.

In the example of FIG. 1, packers 40 have been deployed into wellbore 22 and are ready for actuation against the surrounding wellbore wall 48. Depending on the specific application, wellbore wall 48 may be the wall in an open wellbore or a casing in a cased wellbore. In an open wellbore, packers 40 comprise open wellbore packers that can be set against an uncased wellbore. However, packers 40 also can be selected for actuation against a wellbore casing. In the latter example, perforations are formed through the wellbore casing at each isolated wellbore section 42 to enable flow between the formation 30 and wellbore 22.

Figure 2:
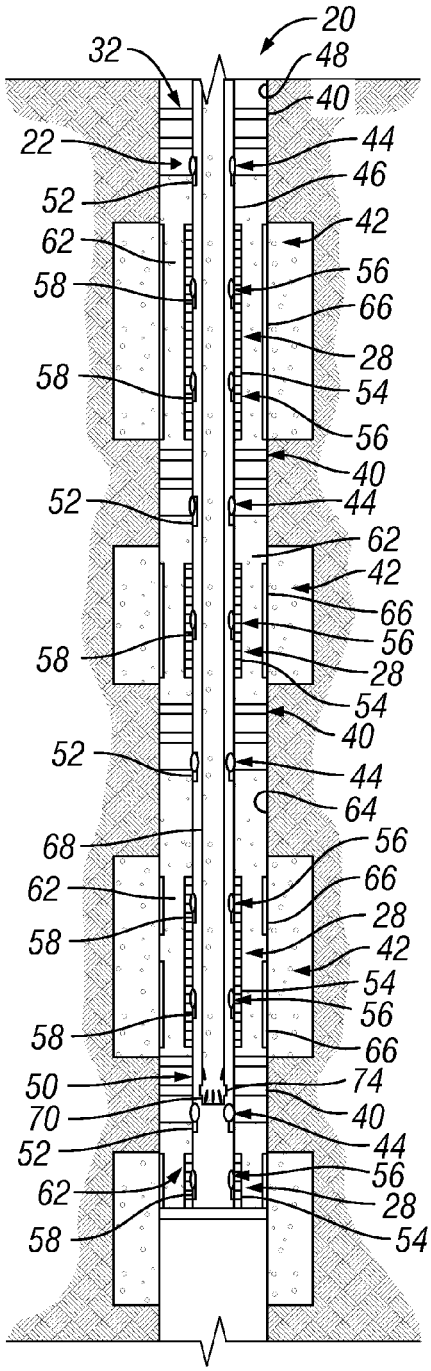
FIG. 2 is a schematic illustration of the tool deployed in a well related application, according to an embodiment of the present invention.

Referring to FIG. 2, one embodiment of well system 20 is illustrated in greater detail with a tool 50. Tool 50 is designed to deliver fluid downhole and to perform as a shifting tool for selectively shifting downhole components, such as flow valves 44 and valves within screen assemblies 28. As illustrated, the packers 40 have been actuated and expanded against wellbore wall 48 to isolate well sections 42. In this embodiment, each flow valve 44 comprises a sliding sleeve 52 that may be selectively engaged by tool 50 and shifted between open and closed positions. In some embodiments, the sliding sleeve 52 can be shifted to intermediate flow positions.

The sliding sleeve 52 can be selectively actuated to block fluid flow from inside tubing string 32 to the surrounding formation 30 within specific well sections 42. It should be noted that other types of valves or mechanisms can be actuated by tool 50 to control the flow of treatment fluid through the tubing string and into each well section 42.

In the example illustrated in FIG. 2, each screen assembly 28 comprises a screen 54 and one or more isolation valves 56 that are integral with each screen 54. As illustrated, some of the screen assemblies 28 may comprise a single isolation valve 56 and other screen assemblies may comprise a plurality of isolation valves 56 depending on, for example, the size of the well section 42 disposed between sequential packers 40. In this embodiment, each isolation valve 56 comprises a sliding sleeve 58 that can be engaged by and actuated via tool 50. The use of a sliding sleeve 58 that is integral with screen 54 provides conformance control by enabling the reduction or blockage of production at select well sections 42. For example, an individual sliding sleeve 58 can be actuated via tool 50 to block flow through a given screen assembly 28 when undesirable fluid/gases are produced at the corresponding well section later in the life of the well.

Once well system 20 is deployed in wellbore 22, a gravel pack 62 can be formed in the annulus surrounding each screen 54. The gravel pack 62 is held in the annulus by the mechanical envelope of the screens 54 and the surrounding formation 30 and acts as a filter media in addition to the screen 54. The gravel packs 62 can be formed in an open hole or a cased hole. In the embodiment illustrated in FIG. 2, for example, the wellbore 22 is cased with a wellbore casing 64 having perforated regions 66 through which fluid is communicated between formation 30 and wellbore 22 during injection or production of fluids. Gravel slurry, fracturing fluid, or other treatment fluids can be delivered to the desired well sections 42 via tool 50, or alternatively, via an annulus formed between the wellbore casing 64 and the coiled tubing assembly deployed within the casing 64 to deliver tool 50 downhole.

Figure 3:
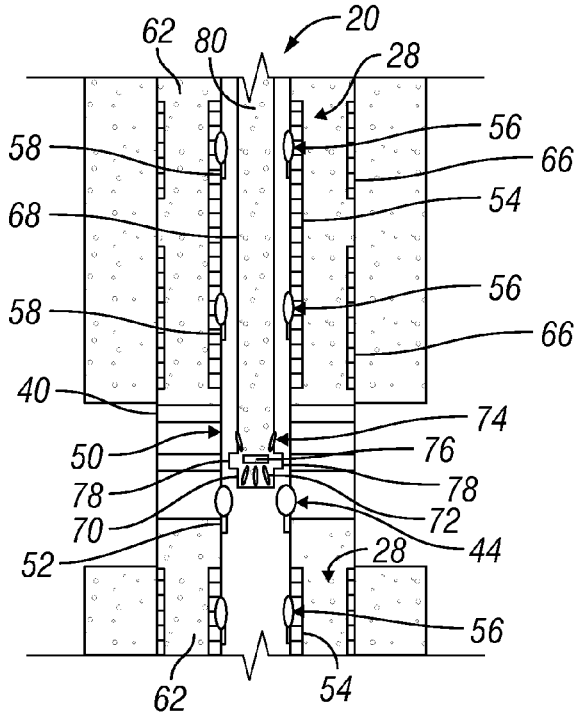
FIG. 3 is an enlarged view of the tool in the well related application illustrated in FIG. 2, according to an embodiment of the present invention.

With additional reference to the enlarged view in FIG. 3, one example of tool 50 is illustrated. In this embodiment, tool 50 is carried on a coiled tubing 68 that delivers tool 50 down through completion 32 and also through conveyance 34. As illustrated, tool 50 comprises a jetting device 70 having one or more orifices or jets 72 through which fluid, such as a treatment fluid, is discharged after traveling down through coiled tubing 68 and tool 50. Tool 50 further comprises a well component shifting device 74 having an actuation mechanism 76 that can be selectively actuated to transition tool 50 between an engaged configuration and a disengaged configuration. When in the engaged configuration, tool 50 can be used to shift selected well components, such as flow valves 44 or isolation valves 56.

By way of example, actuation mechanism 76 may be coupled to one or more engagement members 78 that are selectively moved between a radially contracted position and a radially expanded position. In the radially expanded position, the engagement members 78 are positioned to engage and shift selected well components, e.g. flow valves 44 or isolation valves 56. The actuation mechanism 76 may comprise a variety of mechanisms that cooperate with engagement members 78 to move the engagement members to desired positions for engagement or disengagement. By way of example, actuation mechanism 76 may comprise one or more pistons, expansion chambers, solenoids, or other devices designed to selectively control the radial movement of the engagement members 78. Depending on the type of actuation mechanism, a variety of control lines 80 can be used to deliver control signals downhole to tool 50. By way of example, control line 80 may comprise a hydraulic control line, an electric control line, an optical fiber control line, pressure pulse actuation, or other suitable mechanisms for conveying control signals to actuation mechanism 76.

Figure 4:
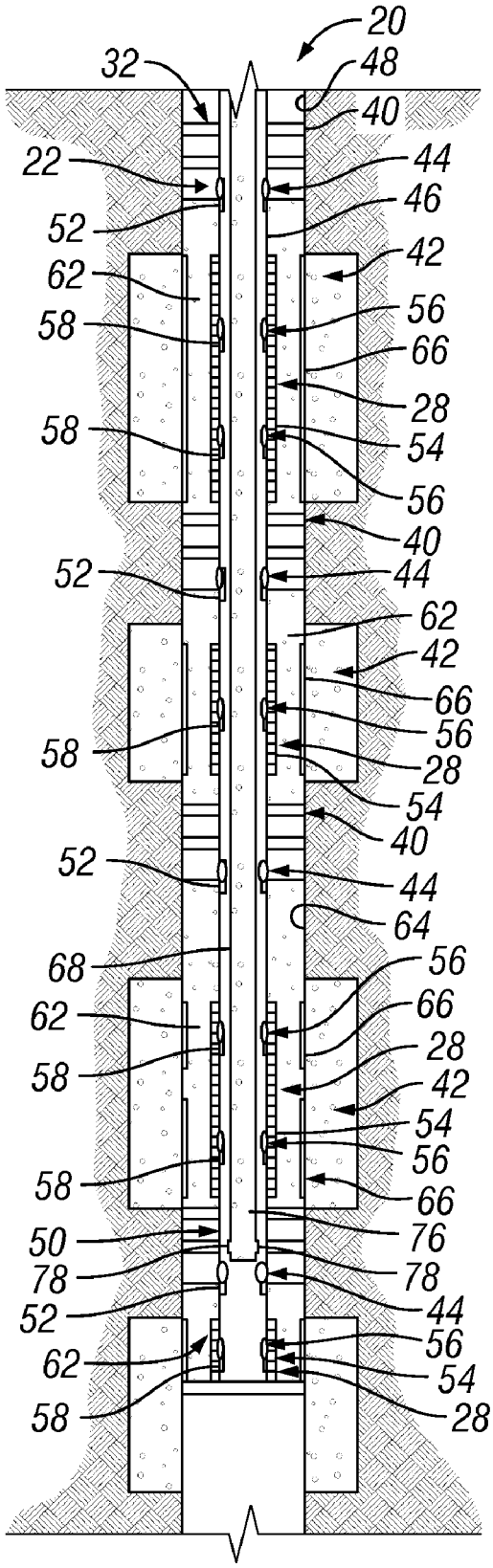
FIG. 4 is a schematic illustration of another example of the tool deployed in a well related application, according to an alternate embodiment of the present invention.

Referring generally to FIG. 4, another embodiment of well system 20 is illustrated in which tool 50 does not include a jetting device. As with the embodiment illustrated in FIG. 2, tool 50 is designed to deliver fluid downhole and to perform as a shifting tool for selectively shifting downhole components, such as flow valves 44 and valves within screen assemblies 28. However, the lack of a jetting device enables different techniques to be employed for delivering treatment fluids downhole. For example, gravel slurry, proppant slurry, solid acid precursor slurry, solid base precursor, or other suitable solids laden fluids could be deliver downhole through coiled tubing 68 or other suitable tubing. Depending on the application, slurry can be pumped downhole through tubing 68 and tool 50 and/or through the surrounding annulus.

The tool 50 and well system 20 can be used in a variety of well treatment and production applications. However, tool 50 also can be utilized with other types of completions and in other downhole, well related applications. In one application example, completion 32 is initially deployed in wellbore 22, as illustrated by block 82 in the flowchart of FIG. 5. Once the screen assemblies 28 and flow valves 44 are deployed in the wellbore, the well sections are isolated along wellbore 22 via packers 40. The tool 50 is then moved into completion 32 on coiled tubing 68, as illustrated by block 84. It should be noted that tool 50 can be moved downhole at the time of completion or at later time periods, as desired for carrying out a specific procedure.

At this stage of the process, a treatment procedure can be carried out by delivering a fluid down through coiled tubing 68 and out through orifices 72 of jetting device 70, as illustrated by block 86. By way of example, jetting device 70 may be placed proximate a selected flow valve 44, and treatment fluid may be discharged radially through the flow valve, into the desired well section 42, and into the surrounding formation 30. The treatment procedure may be, for example, a matrix acidizing procedure in which a stimulation fluid is injected at each well section 42 via the flow valve 44 located in that specific well section. The tool 50, and specifically shifting device 74, can be used to close each successive flow valve 44 to enable treatment applications at each successive well section 42. Coiled tubing 68 is simply withdrawn or deployed to selectively move tool 50 along the interior of completion 32. Each time one of the flow valves 44, or other valves, is to be shifted, a control signal is sent via control line 80 to actuation mechanism 76 and tool 50 is actuated to an engaged position, as illustrated by block 88. The selected valve is then shifted to the desired configuration, as illustrated by block 90. Subsequently, a desired additional well operation can then be continued, as illustrated by block 92.

For example, once a desired flow valve 44 is opened a treatment procedure can be carried out by delivering a fluid down the annulus surrounding coiled tubing 68. Normally, higher rejection rates can be employed when pumping down through the annulus area due to the larger area open to flow. By way of example, if only one flow valve 44 is open and all isolation valves 56 are closed, all treatment fluids are discharged radially through the open flow valve 44, into the desired well section 42, and into the surrounding formation 30. The treatment procedure may comprise, for example, a fracturing procedure in which a fracturing fluid carrying solid materials, e.g. sand/proppant/gravel, is injected at each well section 42 via the flow valve 44 located in that specific well section. In addition or alternatively, the treatment procedure may comprise a packing procedure, e.g. a gravel packing procedure, in which gravel packs 62 are formed in each well section 42. The tool 50, and specifically shifting device 74, can be used to close each successive flow valve 44 to enable treatment applications at each successive well section 42. Coiled tubing 68 is simply withdrawn or deployed to selectively move tool 50 along the interior of completion 32. Each time one of the flow valves 44, or other valves, is to be shifted, a control signal is sent via a control line 80 to actuation mechanism 76. As a result, the tool 50 is actuated to an engaged position in which it is able to shift the selected valve to the desired configuration.

Depending on the application, further procedures can be performed. For example, the well operation may comprise treating subsequent well sections 42. Additionally, the continued well operation may comprise production of well fluid following the treatment procedures. In the latter case, a desired formation fluid can be flowed into wellbore 22 and into completion 32 via the screen assemblies 28. The isolation valves 56 of screen assemblies 28 can be shifted via tool 50 to restrict or close off flow through specific screen assemblies as desired to improve production. For example, one or more of the well sections 42 may begin to produce gas, water or other undesirable fluids at some point during the life of the well. The use of integral isolation valves 56 enables an operator to selectively block the inflow of these undesirable fluids through the corresponding screen 54 when the corresponding well section 42 no longer adequately produces the desired production fluid, e.g. oil, aqueous based fluid, water, gas, bitumen, and the like.

The use of tool 50 on coiled tubing 68 provides a quick and efficient technique for shifting a variety of well components between component configurations. The ability to actuate tool 50 between engaged and disengaged positions further enables selective operation of numerous valves and other shiftable components within a given completion or completions. Accordingly, tool 50 can be employed in numerous well applications.

Figure 5:
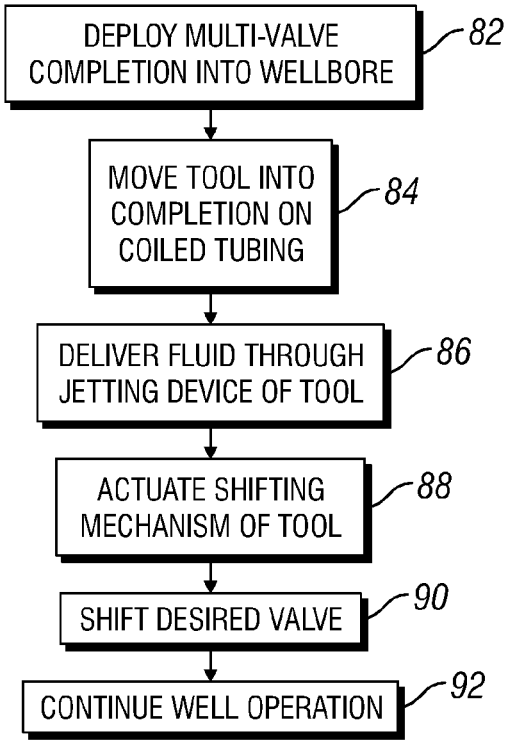
FIG. 5 is a flowchart illustrating one well related application in which the tool is utilized, according to an embodiment of the present invention.
Figure 6:
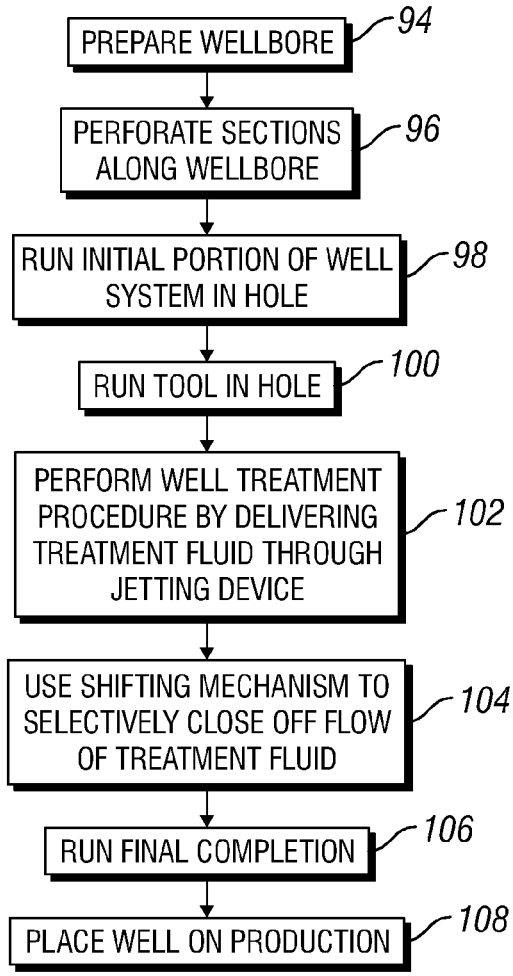
FIG. 6 is a flowchart illustrating another well related application in which the tool is utilized, according to an embodiment of the present invention.

In FIG. 5, for example, another procedure that benefits from the use of tool 50 delivered on coiled tubing 68 is illustrated in flowchart form. In this example, the well is initially prepared, as illustrated by block 94. Preparation of the well may involve drilling the well, casing the well, removing an old completion from an existing well, reducing the amount of completion skin to provide each interval/section with an opportunity to be produced to its full capacity, or other procedures designed to facilitate well treatment and/or production. The well may be prepared, for example, in sand bodies of multiple low-pressure, weak formations. The well also may be prepared in mature fields that are intended for production from multiple zones via an artificial lift mechanism, such as a high rate electric submersible pumping system.

Once the wellbore is prepared, perforations 66 are formed in each of the well sections 42, as illustrated by block 96. The completion 32 of well system 20 is then run in hole, as illustrated by block 98, and the packers 40 are set to isolate well sections 42. Tool 50 is then run downhole on coiled tubing 68 and moved into completion 32, as illustrated by block 100. Again, tool 50 can be run at the time that completion string 32 is run, or tool 50 can be run at a later time when needed to shift selected well components.

A treatment procedure can then be performed in each isolated well section 42, as illustrated by block 102. The treatment procedure may comprise delivering treatment fluid to a desired well section 42 through jetting device 70. Additionally, the treatment procedure may comprise sequentially performing a fracturing procedure and/or gravel packing procedure at each of the isolated well zones 42 by pumping slurry down through the surrounding annulus. The sequential performance of procedures in successive well sections 42 is facilitated by tool 50 and shifting mechanism 74 which can be used to selectively close off flow of treatment fluid to well sections that have already been treated, as illustrated by block 104.

A final completion is then run downhole, as illustrated by block 106. The final completion may comprise a variety of production related completions, including completions designed for artificially lifting production fluids to a desired collection location. For example, an electric submersible pumping system can be delivered downhole to pump the fluids that collect within the well system 20. With the final completion in place, the well can be placed on production to deliver production fluids to the desired collection location, as illustrated by block 108. During production, the sliding sleeves 58 of screen assemblies 28 focus the fluid production and thus facilitate identification of well sections 42 that have high water cut or high gas influx. In the event the water cut or gas influx becomes excessive, a properly designed final completion allows tool 50 to be moved via coiled tubing to the appropriate isolation valve 56. The tool 50 is then activated to shift the valve to a closed or reduced flow position.

As described above, tool 50 and well system 20 can be constructed in a variety of configurations for use in many environments and applications. Additionally, the size and arrangement of the components can be adjusted according to the environment and according to the desired well procedures, e.g. treatment or production related procedures. A variety of jetting devices and actuation mechanisms can be used with tool 50 as desired for use with a given well system 20. Also, the packers or other isolation devices can be used in both open hole and cased hole applications. Various types of screens 54 and isolation valves 56 can be used in the screen assemblies 28. For example, the isolation valves 56 may comprise a variety of valve types that can be actuated between open flow and closed flow configurations. In some embodiments, the isolation valves 56 may selectively be actuated to positions of reduced flow in which some flow is allowed. Additionally, flow valves 44 can be selected to accommodate a variety of treatment fluids and treatment procedures.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method, comprising:

deploying a tubular structure in a wellbore;

isolating a plurality of sections along an annulus surrounding the tubular structure;

deploying a tool on a tubing in the tubular structure with an inner annulus being formed between the tubing and the tubular structure, the tool having a jetting device and a valve shifting mechanism;

performing a well treatment procedure at each section by shifting open a flow valve with the tool and pumping solids laden fluid through the inner annulus and flow valve in each section;

the well treatment procedure at each section further comprising pumping fluid through the tubing and jetting device to fluidize and circulate solids from the tubular structure via the inner annulus so as to clean the inner annulus of the tubular structure in the section being treated after the start of the step of pumping solids laden fluid through the inner annulus and flow valve;

the well treatment procedure at each section further comprising shifting the flow valve in the section being treated closed with the tool at a time after the start of pumping solids laden fluid through the inner annulus and flow valve, and at a time after the start of pumping fluid through the tubing and jetting device;

flowing a fluid into the tubular structure at each section through a screen assembly having an isolation valve; and shifting at least one of the isolation valves with the tool delivered down into the tubular structure on the tubing.

2. The method as recited in claim 1, wherein shifting comprises actuating the tool in a manner that moves engagement members in a radially outward direction sufficient to engage a select flow valve or isolation valve.

3. The method as recited in claim 1, wherein shifting comprises moving the tool through the tubular structure via coiled tubing.

4. The method as recited in claim 1, wherein isolating comprises actuating a plurality of packers.

5. The method as recited in claim 1, wherein performing comprises sequentially fracturing each section.

6. The method as recited in claim 1, wherein flowing comprises flowing a production fluid.

* * * * *